US008233255B1

(12) United States Patent
Ford et al.

(10) Patent No.: US 8,233,255 B1
(45) Date of Patent: Jul. 31, 2012

(54) SYSTEMS AND METHODS OF POWER CONVERSION FOR ELECTROSTATIC PRECIPITATORS

(75) Inventors: Paul Ford, Hillsborough, NJ (US); John Jannone, Hillsborough, NJ (US); Neil Flynn, Hillsborough, NJ (US); Hank Del Gatto, Hillsborough, NJ (US)

(73) Assignee: Redkoh Industries, Inc., Hillsborough, NJ (US)

( * ) Notice: Subject to any disclaimer, the term of this patent is extended or adjusted under 35 U.S.C. 154(b) by 775 days.

(21) Appl. No.: 12/416,607

(22) Filed: Apr. 1, 2009

Related U.S. Application Data

(60) Provisional application No. 61/041,495, filed on Apr. 1, 2008.

(51) Int. Cl.
*G03G 15/02* (2006.01)

(52) U.S. Cl. ..... 361/79; 361/235

(58) Field of Classification Search ..... 361/79, 361/235

See application file for complete search history.

(56) References Cited

U.S. PATENT DOCUMENTS

| | | | | |
|---|---|---|---|---|
| 3,758,840 | A | 9/1973 | Oliver | |
| 3,971,976 | A | 7/1976 | Baker | |
| 4,533,987 | A | 8/1985 | Tomofuji et al. | |
| 4,665,476 | A | 5/1987 | Masuda | |
| 4,713,093 | A | 12/1987 | Hansson | |
| 4,779,182 | A | 10/1988 | Mickal et al. | |
| 4,860,149 | A * | 8/1989 | Johnston | 361/79 |
| 5,124,905 | A | 6/1992 | Kniepkamp | |
| 5,255,178 | A * | 10/1993 | Liberati | 96/80 |
| 5,311,419 | A | 5/1994 | Shires | |
| 5,542,967 | A | 8/1996 | Ponizovsky et al. | |
| 5,575,836 | A * | 11/1996 | Sugiura et al. | 96/82 |
| 5,601,633 | A | 2/1997 | Ponizovsky et al. | |
| 5,639,294 | A | 6/1997 | Ranstad | |
| 5,771,163 | A | 6/1998 | Moriguchi et al. | |
| 5,926,381 | A | 7/1999 | Moriguchi et al. | |
| 6,181,576 | B1 | 1/2001 | Ikeda et al. | |
| 6,224,653 | B1 | 5/2001 | Shvedchikov et al. | |
| 6,282,106 | B2 | 8/2001 | Grass | |
| 6,461,405 | B2 | 10/2002 | Reyes | |
| 6,611,440 | B1 | 8/2003 | Johnston et al. | |
| 6,813,123 | B2 | 11/2004 | Pihl | |
| 6,839,251 | B2 | 1/2005 | Johnston et al. | |
| 7,300,493 | B2 | 11/2007 | Kim et al. | |

FOREIGN PATENT DOCUMENTS

EP 0034075 A2 8/1981

* cited by examiner

*Primary Examiner* — Danny Nguyen
(74) *Attorney, Agent, or Firm* — Ryan A. Schneider, Esq.; Troutman Sanders LLP

(57) ABSTRACT

The present invention describes methods and apparatus to convert and control power provided to a precipitator. An exemplary embodiment of the present invention provides a precipitator power frequency converter system, which includes an insulated-gate bipolar transistor ("IGBT") system and a converter control system comprising a microprocessor in communication with the IGBT system. In addition, the power frequency converter system provides a rectifier set in communication with the IGBT system. Furthermore, the input power received by the precipitator power frequency converter system is in a first frequency range of approximately 50 Hz to 60 Hz and the precipitator power frequency converter system can be enabled to provide an output power in a second frequency range between 400 Hz and 1000 Hz.

11 Claims, 8 Drawing Sheets

SYSTEMS AND METHODS OF POWER CONVERSION FOR ELECTROSTATIC PRECIPITATORS

CROSS REFERENCE TO RELATED APPLICATION

This application claims the benefit of U.S. Provisional Application No. 61/041,495, filed 1 Apr. 2008, which is hereby incorporated by reference in its entirety as if fully set forth below.

FIELD OF THE INVENTION

This invention relates generally to the field of power supplies, and specifically to systems and methods to convert the power supplied to electrostatic precipitators.

BACKGROUND

Electrostatic precipitators are used in a variety of different applications, including filtering particulate from the emissions of a power plant coal combustion process. An electrostatic precipitator is a particulate collection device capable of removing particles from flowing gas using the force of an induced electrostatic charge. An electrostatic precipitator typically has a negative voltage energy field and a positive voltage energy field. In practice, the flowing gas passes first through the negative voltage energy field, and the solid particulate is negatively charged. The negatively charged solid particulate matter is attracted to, and collected on, a positive collecting plate.

To be effective, an electrostatic precipitator must be enabled to hold a precise and consistent amount of electrical charge. Thus, electrostatic precipitators require precise and efficient power supplies to apply the proper potential to the precipitator. Conventional power supplies for electrostatic precipitators are often inefficient. Furthermore, many prior art systems that can enable the supply of power at a relatively high frequency range are costly to implement and are incompatible with existing electrostatic precipitator systems. Therefore, it is highly desired to provide a device that is compatible with existing hardware and enabled to provide a more efficient and controlled power source for an electrostatic precipitator.

BRIEF SUMMARY

The present invention describes methods and apparatus to convert and control power provided to a device. In an exemplary embodiment, the device is a electrostatic precipitator.

In exemplary embodiment of the present invention, a precipitator power frequency converter system is provided, which includes an insulated-gate bipolar transistor ("IGBT") system and a converter control system comprising a microprocessor in communication with the IGBT system. In addition, the power frequency converter system provides a rectifier set in communication with the IGBT system. Furthermore, the input power received by the precipitator power frequency converter system is in a first frequency range of approximately 50 Hz to 60 Hz and the precipitator power frequency converter system can be enabled to provide an output power in a second frequency range between 400 Hz and 1000 Hz.

In an exemplary embodiment of the present invention, a method for precipitator power frequency conversion is provided that includes receiving a first silicon controlled rectifier ("SCR) signal and a second SCR signal from a transformer rectifier control device. Additionally, the method for precipitator power frequency conversion includes comparing the first and second SCR signal to the point at which the input voltage of a power source passes through zero. Furthermore, the method includes generating a demand signal based on the comparison, and enabling the demand signal to actuate an insulated-gate bipolar transistor ("IGBT") system.

These and other objects, features and advantages of the present invention will become more apparent upon reading the following specification in conjunction with the accompanying drawing figures.

DETAILED DESCRIPTION

Figure 1:
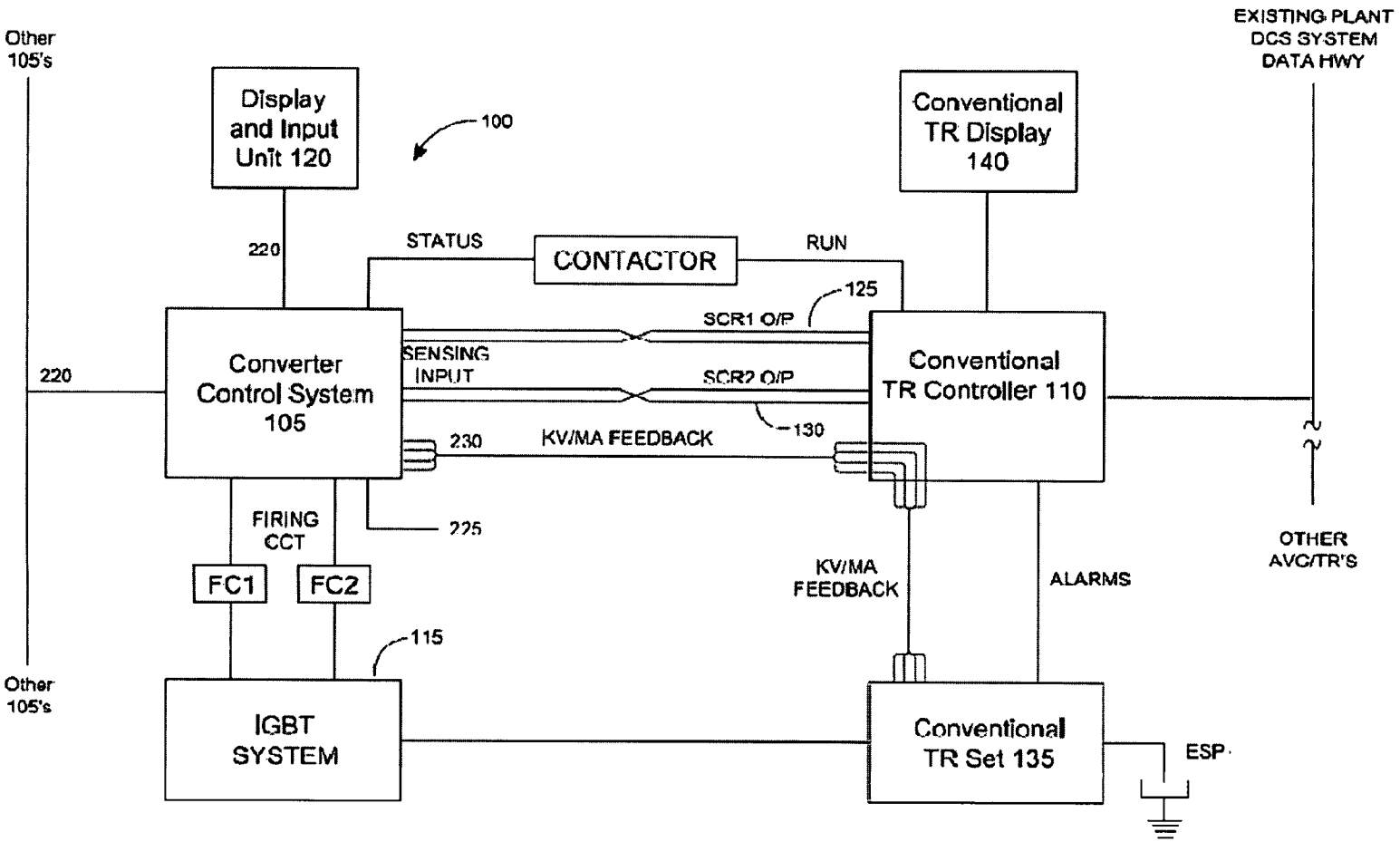
FIG. 1 provides a block diagram of the precipitator power frequency converter system 100 in accordance with an exemplary embodiment of the present invention.

To facilitate an understanding of the principles and features of the invention, it is explained hereinafter with reference to its implementation in an illustrative embodiment. In particular, the invention is described in the context of being a power converter and controller capable of efficiently and effectively providing power to a precipitator.

The device components described hereinafter as making up the various elements of the invention are intended to be illustrative and not restrictive. Many suitable components that would perform the same or a similar function as the components described herein are intended to be embraced within the scope of the invention. Such other components not described herein can include, but are not limited to, for example, components that are developed after the time of the development of the invention.

The present invention addresses the deficiencies of the prior art with respect to the ability to provide a power signal to an electrostatic precipitator in a mid-frequency range. In an exemplary embodiment, the present invention provides a precipitator power frequency converter system for an electrostatic precipitator power supply. More particularly, a precipitator power frequency converter system is provided specifically for use on electrostatic precipitators. The precipitator power frequency converter system can be incorporated into a variety of existing electrostatic precipitator control systems.

The precipitator power frequency converter system has a number of benefits over both the low frequency and high frequency power supplies. The precipitator power frequency converter system provided in accordance with an exemplary embodiment of the present invention can provide improved reliability, lower Electromagnetic Interference ("EMI"), improved control techniques and faster responses than prior art systems.

In an exemplary embodiment, the precipitator power frequency converter system includes control software. The control software not only provides the system with a fundamental 400 to 1000 Hz switched power supply to the electrostatic precipitator, but also ensures that the potential applied to the electrostatic precipitator is in such a manner as to maintain the highest level of performance and the minimum level of disruption. In an exemplary embodiment, the precipitator power frequency converter system utilizes both hardware and software driven protection elements to manage both control and precipitator faults.

In an exemplary embodiment, the design platform and data communications software of the precipitator power frequency converter system is compatible with prior art power supply controllers. In an exemplary embodiment, the precipitator power frequency converter system can permit the user to maintain use of conventional 60/50 Hz Transformer Rectifier ("TR") sets but also purpose designed more compact 400-1000 Hz Transformer Rectifiers.

The precipitator power frequency converter system can be implemented in a variety of existing and conventional electrostatic precipitator configurations. For example, and not limited to, in an exemplary embodiment the precipitator power frequency converter system can be used by those customers who have smaller precipitators and whose budgets and needs do not require changing complete systems. The precipitator power frequency converter system can assist with the determination as to the likely effects a precipitator may experience as it switches between conventional and higher frequency energization.

The precipitator power frequency converter system relies upon a set of Insulated-Gate Bipolar Transistor ("IGBT's") to develop voltage that enhances the performance of the electrostatic precipitator. In an exemplary embodiment, the precipitator power frequency converter system design pays specific attention to the fact that earlier controls have relied on voltage "Zero Crossings" to determine when voltage may be applied to the transformer rectifier set. In this exemplary embodiment, following this attribute allows the precipitator power frequency converter system to be utilized within the context of existing Silicon Controlled Rectifier ("SCR") based and existing transformer rectifier controls.

In an exemplary embodiment, the precipitator power frequency converter system is enabled to receive SCR signals from a conventional TR control device to determine the level of power to be applied to the precipitator load. In an exemplary embodiment, the precipitator power frequency converter system can include an on-board microprocessor to convert the SCR signals output from a conventional TR control device into a firing signal suitable for use with an IGBT based mid frequency power supply, so that the power applied to the precipitator can be converted from the standard 100/120 Hz to the mid frequency range of 400-1000 Hz.

In an exemplary embodiment, a three phase supply can be used to power the precipitator power frequency converter system. The three phases can be applied in an exemplary embodiment via a suitably rated MCCB to a full wave three phase rectifier to convert the power from an AC signal to a DC signal. This DC power can be applied to a capacitor bank in an exemplary embodiment that further smoothes the power signal and stores it as a charge ready for use by a set of switching IGBT's. Upon enabling an exemplary embodiment of the precipitator power frequency converter system, a microprocessor can close a contactor and set the system in operation. In an exemplary embodiment, the microprocessor of the precipitator power frequency converter system can generate a firing signal that determines the frequency and the output that the IGBT system will provide. This output can be delivered in an exemplary embodiment via output terminals to a current limiting rector and then to the primary of a transformer rectifier. In this exemplary embodiment, the transformer rectifier can convert the switched AC voltage to a high DC voltage for further application to the electrostatic precipitator.

In an exemplary embodiment, the precipitator power frequency converter system provides a converter control system to monitor feedback signals from potential transformers, current transformers and from the IGBT driver circuits to ensure safe and efficient operation of both the precipitator power frequency converter system and the precipitator. In an exemplary embodiment, the converter control system can further monitor the voltage applied to, and the current drawn by the precipitator in order to control the high voltage output to within the most acceptable and efficient operating conditions.

In exemplary embodiment of the present invention, a precipitator power frequency converter system is provided, which includes an insulated-gate bipolar transistor ("IGBT") system and a converter control system comprising a microprocessor in communication with the IGBT system. In addition, the power frequency converter system provides a rectifier set in communication with the IGBT system. Furthermore, the input power received by the precipitator power frequency converter system is in a first frequency range of approximately 50 Hz to 60 Hz and the precipitator power frequency converter system can be enabled to provide an output power in a second frequency range between 400 Hz and 1000 Hz.

In an exemplary embodiment of the present invention, a method for precipitator power frequency conversion is provided that includes receiving a first silicon controlled rectifier ("SCR") signal and a second SCR signal from a transformer rectifier control device. Additionally, the method for precipitator power frequency conversion includes comparing the first and second SCR signal to the point at which the input voltage of a power source passes through zero. Furthermore, the method includes generating a demand signal based on the comparison, and enabling the demand signal to actuate an insulated-gate bipolar transistor ("IGBT") system.

Referring now to the figures, wherein like reference numerals represent like parts throughout the figures, the present digital collage display system will be described in detail.

FIG. 1 provides a block diagram of the precipitator power frequency converter system 100 in accordance with an exemplary embodiment of the present invention. In an exemplary embodiment, the precipitator power frequency converter system 100 includes a converter control system 105. The converter control system 105 includes control logic enabled to monitor a conventional TR controller 110 and control an IGBT system 115. The IGBT system 115, in an exemplary embodiment of the precipitator power frequency converter system 100, can be switched mode power supply unit. The IGBT system 115 can enable the output of an exemplary embodiment of the precipitator power frequency converter system 100 to be controlled in terms of conduction angle and frequency.

In the exemplary embodiment shown in FIG. 1, the converter control system 105 is configured to receive input from the conventional TR controller 110. In an exemplary embodiment, the converter control system 105 can receive the Silicon Controlled Rectifier ("SCR") outputs, 125 and 130, from the conventional TR controller 110. The SCR outputs, 125 and 130, can act as a control signal for an exemplary embodiment of the converter control system 105.

In an exemplary embodiment, the converter control system 105 can be provided in connection to a display and input unit 120. In an exemplary embodiment of the precipitator power frequency converter system 100, the display and input unit 120 can provide a user with an interface to the converter control system 105 to permit configuration and modification of the settings and operation of the precipitator power frequency converter system 100. Those of skill in the art will appreciate that the display and input unit 120 can be a device that is permanently attached to the precipitator power frequency converter system 100 in some embodiments, and in other embodiments the display and input unit 120 is removable from the system. For example and not limitation, in one embodiment, the display and input unit 120 is a portable computer that can communicate with the converter control system 105 over a wireless link when in sufficient proximity to the system 105. For example and not limitation, in one embodiment, the display and input unit 120 is a portable computer that can communicate with the converter control system 105 over a wireless link when in sufficient proximity to the system 105.

Figure 2:
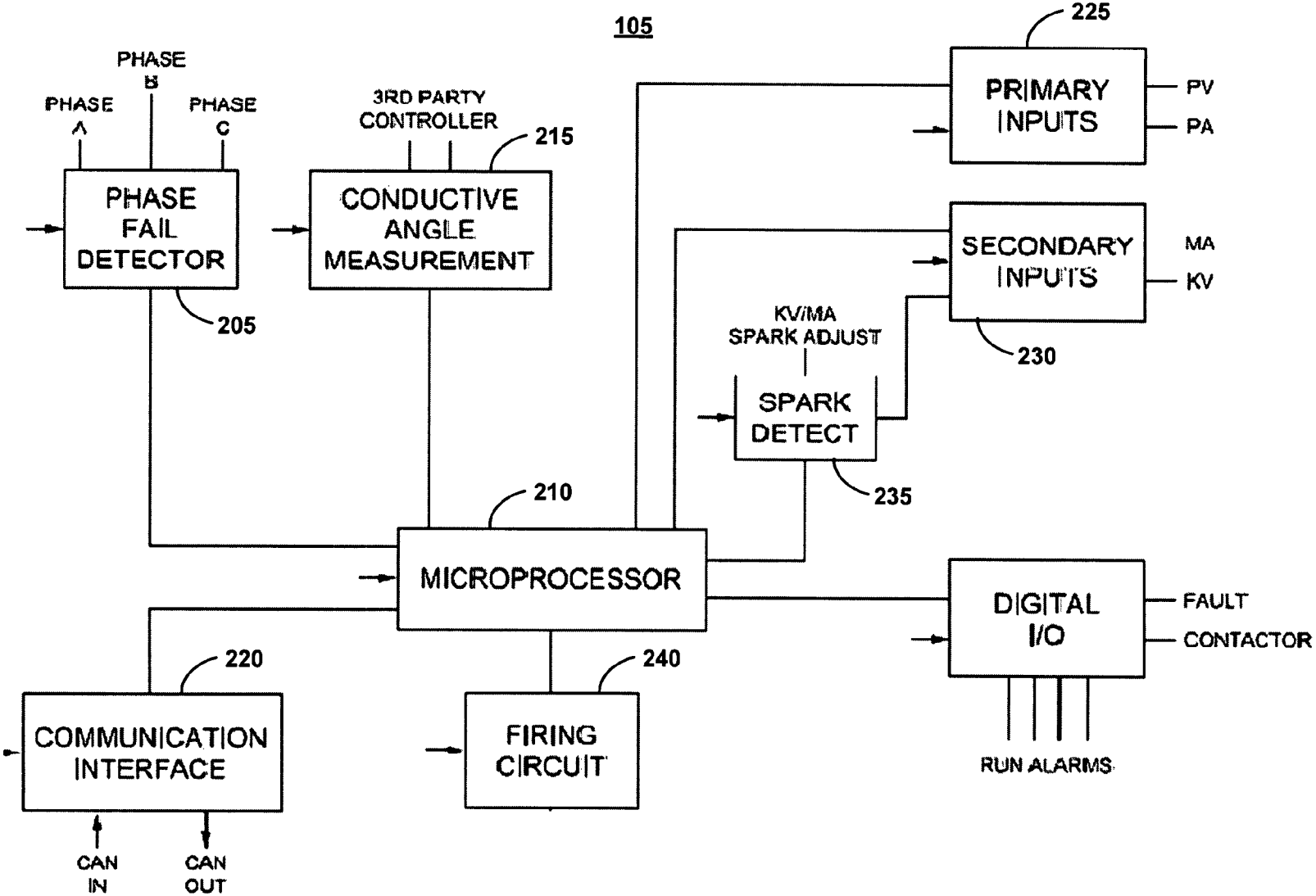
FIG. 2 provides a block diagram of the converter control system 105 in accordance with an exemplary embodiment of the present invention.

FIG. 2 provides a block diagram of the converter control system 105 in accordance with an exemplary embodiment of the present invention. In an exemplary embodiment, the converter control system 105 includes a phase fail detector 205 that can be configured to detect the presence of all three phases of an input power supply. The phase fail detector 205 can be enabled to ensure that the main power capacitors of an exemplary embodiment of the precipitator power frequency converter system 100 receive sufficient field power and are not be subjected to damaging amounts of ripple. In an exemplary embodiment, the phase fail detector 205 can be provided in connection to a power input arranged as an arithmetic summing amplifier, in which the voltage that arrives at the converter control system 105 is the sum of each of the three phases of the power supply. In this embodiment, the failure of any one of three phases will reduce the voltage sensed by the phase fail detector 205 of the converter control system 105.

In the event that an exemplary embodiment of the phase fail detector 205 detects that one or more of the three phases of input power is deficient, then the phase fail detector 205 can be configured to send a signal to the microprocessor 210 of the converter control system 105. The signal sent by an exemplary embodiment of the phase fail detector 205 can provide an indication as to the level of failure of the input power. In an exemplary embodiment, the microprocessor 210 can analyze the signal from the phase fail detector 205 and determine the proper adjustment to the operation of the converter control system 105. For example, and not limitation, the microprocessor 210 can determine whether it is safe to fire the IGBT system 115 at a level above a predetermined "Safe Level" of power operation. In one embodiment, the microprocessor 210 can instruct the precipitator power frequency converter system 100 to operate in a state of alarm and reduced output. In an alternative embodiment, the microprocessor 210 can receive the signal from the phase fail detector 205 and cause the precipitator power frequency converter system 100 to shutdown and remain locked until the failure detected by the phase fail detector 205 is restored.

As shown in FIG. 2, an exemplary embodiment of the converter control system 105 can include a conductive angle measurement device 215 configured to receive the SCR outputs, 125 and 130, from a conventional TR controller 110 (shown in FIG. 1). The SCR outputs, 125 and 130, can provide the conductive angle measurement device 215 of an exemplary embodiment of the converter control system 105 with control signals. These control signals received by the conductive angle measurement device 215 can be optically coupled in an exemplary embodiment. In an exemplary embodiment, the conductive angle measurement device 215 can evaluate this signal in comparison to the zero cross point, the point at which the input voltage passes through zero. The SCR outputs, 125 and 130, from a conventional TR controller 110 can be analyzed by microprocessor 210 in an exemplary embodiment. When the input power, such as the "line" voltage, passes through the zero level, an interrupt can be generated for the microprocessor 210 in an exemplary embodiment, and a similar interrupt can be generated from reading the SCR outputs, 125 and 130. In an exemplary embodiment, the converter control system 105, having read the two interrupts is then able to determine the demand of the Conventional TR Controller 110. This demand is manipulated for the change in frequencies by an exemplary embodiment of the converter control system 105 and can be used as a Demand to control the conduction angle communicated to the IGBT system 115. The Demand signal in an exemplary embodiment can represent the requirement for the transformer rectifier.

An exemplary embodiment of the converter control system 105, as shown in FIG. 2, can include a communication interface 220 that enables the converter control system 105 to communicate with other devices, including input/output devices and other control devices. In an exemplary embodiment, the converter control system 105 also provides primary inputs 225, which can be the transformer/rectifier primary signals derived from the primary voltage and current feedback from the conventional TR controller 110. These primary inputs 225 can be used in an exemplary embodiment to verify the outputs of the converter control system 105. Furthermore, the primary inputs 225 can enable the converter control system 105 to ensure compliance with the rating of the hardware external to the precipitator power frequency converter system 100.

The exemplary embodiment of the converter control system 105 shown in FIG. 2 also provides secondary inputs 230 made up of the secondary voltage and secondary current feedback signals derived from the high voltage conventional TR set 135. The secondary inputs 230 can be relied on by an exemplary embodiment of the converter control system 105 to verify that that the outputs of the precipitator power frequency converter system 100 are correctly applied to the electrostatic precipitator being powered. More specifically, the microprocessor 210 of an exemplary embodiment of the converter control system 105 can monitor the second inputs 230 to ensure compliance with the ratings of the hardware external to the precipitator power frequency converter system 100.

Additionally, as shown in FIG. 2, in an exemplary embodiment the secondary inputs 230 can be configured in communication with both the microprocessor 210 and a spark detection device 235. The spark detection device 235 in an exemplary embodiment of the converter control system 105 enables spark and arc detection by the precipitator power frequency converter system 100. Sparking is a phenomenon that limits the electrical energization of the electrostatic precipitator. This is when the gas that is being treated in the exhaust stack has a localized breakdown so that there is a rapid rise in electrical current with an associated decrease in voltage. Therefore, instead of having the corona current distributed evenly across the entire field for the electrostatic precipitator, there is a high amplitude spark that funnels all of the available current in one path rather than an innumerable number of paths. This can cause damage to the internal components of the electrostatic precipitator as well as disrupt the entire operation of the electrostatic precipitator. An exemplary embodiment of the spark detection device 235 enables the converter control system 105 to detect and prevent the damage that can result from sparking within an electrostatic precipitator.

As shown in the exemplary embodiment in FIG. 2, the spark detection device 235 can be configured to receive the secondary inputs 230 made up of the secondary voltage and secondary current feedback signals derived from the high voltage conventional TR set 135. The spark detection device 235 in an exemplary embodiment can determine when preprogrammed level of disruption in the power provided to an electrostatic precipitator has occurred. The spark detection device 235 can provide a signal to the microprocessor 210 of an exemplary embodiment of the converter control system 105 to indicate that sparking or arcing has occurred in the electrostatic precipitator. The microprocessor 210 can be configured to take a variety of different actions based upon the signal provided by the spark detection device 235. For example, and not limitation, the microprocessor 210 can require a quench or setback of power supplied by the precipitator power frequency converter system 100 to dissipate the spark or arc. In some embodiments, the microprocessor 210 can be configured to provide the quench or setback instruction without regard to the Demand signal from the conventional TR controller 110. Once the spark detection device 235 determines that the spark or arc has dissipated, in an exemplary embodiment, the microprocessor 210 can instruct the precipitator power frequency converter system 100 to resume normal operation.

An exemplary embodiment of the converter control system 105 can provide a firing circuit 240. The firing circuit 240 can be configured in an exemplary embodiment to receive the Demand signal generated by the microprocessor 210 of the converter control system 105. In an exemplary embodiment, the firing circuit 240 is enabled to convert the Demand signal into a signal capable of driving the IGBT system 115 (shown in FIG. 1). Those of skill in the art will appreciate that the Demand signal from the microprocessor 210 can be a relatively low level digital signal in an exemplary embodiment and the IGBT system 115 may require a higher voltage signal to drive the firing cards of the IGBT system 115. Additionally, the frequency of the Demand signal in an exemplary embodiment can be directly related to the frequency at which the IGBT system 115 can be switched. In an exemplary embodiment, the firing circuit 240 can monitor the current flow in the IGBT system 115. The ability to monitor the IGBT system 115 with the firing circuit 240 can enable signals to be sent back to the microprocessor 210 to override the Demand signal in the event that an exceptional situation is present in the IGBT system 115, such as a circumstance that requires a more rapid response.

Figure 3:
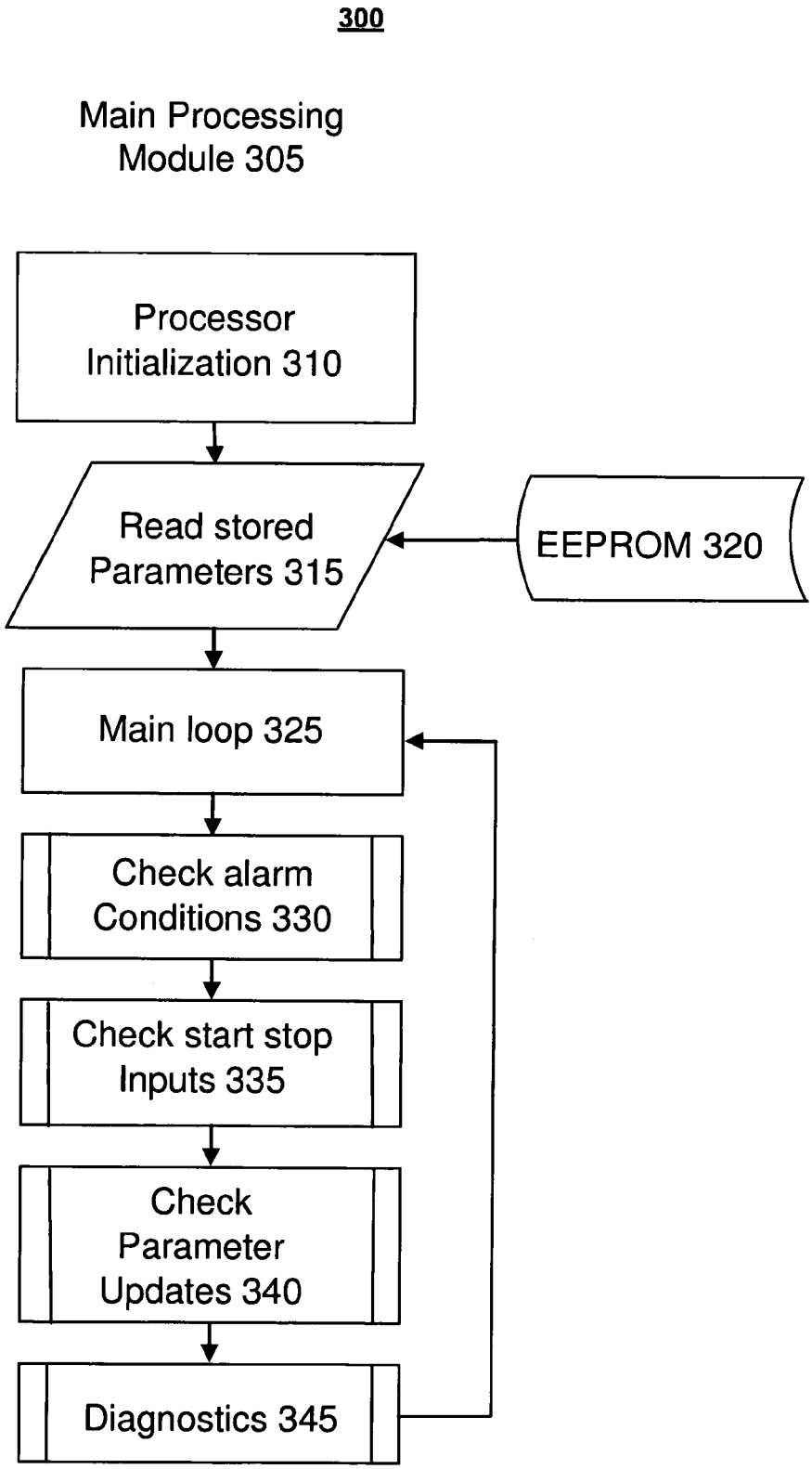
FIG. 3 provides a flow chart for the main processing module 305 of the method for precipitator power frequency conversion 300 in accordance with an exemplary embodiment of the present invention.

FIG. 3 provides a flow chart for the main processing module 305 of the method for precipitator power frequency conversion 300 in accordance with an exemplary embodiment of the present invention. In an exemplary embodiment, the converter control system 105 is enabled to store and operate a software application that executes the method for precipitator power frequency conversion 300. The method for precipitator power frequency conversion 300 in an exemplary embodiment provides a main processing module 305 as shown in FIG. 3 for executing the main functions of the software application. As shown in FIG. 3, the first step 310 of an exemplary embodiment of the main processing module 305 undergoes a processor initialization sequence 310. In an exemplary embodiment, the processor initialization sequence 310 involves powering up and initializing the microprocessor 210 of the converter control system 105. Additionally, in an exemplary embodiment the processor initialization sequence 310 involves initializing the microprocessor 210 input and output pins and the embedded smart peripherals of the converter control system 105. In an exemplary embodiment, the peripherals of the converter control system 105 can include timers, a pulse width modulation controller, an input capture unit, and a communications controller. Those of skill in the art will appreciate that a variety of the different peripherals could be included in the converter control system 105, depending upon the requirements of an given implementation.

Once the first step of processor initialization 310 is complete, the second step 315 of reading stored parameters of an exemplary embodiment of the method for precipitator power frequency conversion 300 can be executed. In the "read stored parameters" step 315 of an exemplary embodiment of the method for precipitator power frequency conversion 300, the microprocessor 210 can read stored initialization and other parameter values from a non-volatile memory source, such as Electrically Erasable Programmable Read Only Memory ("EEPROM") 320 shown in FIG. 3. Those of skill in the art will appreciate that the parameters stored in the EEPROM 320 can include a variety of different predetermined and user-configurable settings for the precipitator power frequency converter system 100. In an exemplary embodiment of the converter control system 105, the parameters from the non-volative EEPROM 320 are read into a volatile memory provided in communication with the microprocessor 210 for access and execution by the various processes of the method for precipitator power frequency conversion 300.

After the read stored parameters step 315 is executed by the microprocessor 210, the main loop 325 of an exemplary embodiment of the method for precipitator power frequency conversion 300 can be initiated. In the main loop 325, the method for precipitator power frequency conversion 300 can be configured to iteratively perform the functions of the converter control system 105. The first step 330 of the main loop 325 of an exemplary embodiment of the method for precipitator power frequency conversion 300 is to check alarm conditions 330. Those of skill in the art will appreciate that the alarm conditions evaluated in step 330 can vary upon implementation. In one embodiment, the method for precipitator power frequency conversion 300 involves checking the alarm conditions of the phase fail detector 205 of the converter control system 105 to determine whether a failure exists in the three phases of supplied power. Additionally, in one embodiment the method for precipitator power frequency conversion 300 involves checking the alarm conditions of the spark detection device 235 to determine whether a sparking or arcing condition is present in the precipitator powered by an exemplary embodiment the precipitator power frequency converter system 100. In addition to checking external input signals, in an exemplary embodiment the microprocessor 210 executing the check alarm conditions step 330 can evaluate the internal operating conditions for various alarm conditions.

In an exemplary embodiment, the main loop 325 of the method for precipitator power frequency conversion 300 can include the step 335 of checking start/stop inputs. This step 335 can include monitoring input signals after power to the electrostatic precipitator is stopped to determine if permission has been given to begin firing the IGBT system 115 of the precipitator power frequency converter system 100. As shown in FIG. 3, the main loop 325 of the method for precipitator power frequency conversion 300 can include the step 340 of checking for parameter updates. In an exemplary embodiment, this step 340 can enable the user of the converter control system 105 to change the operating parameters of the system 105. For instance, the user could change the safe level at which power is stopped upon detection by the phase fail detector 205. In an exemplary embodiment, the method for precipitator power frequency conversion 300 is continually executing the step 340 of checking for parameter updates and will modify the settings of the system 105 as soon as the changes are input by the user or system 100. The method for precipitator power frequency conversion 300 can also include a diagnostics step 345 in an exemplary embodiment to perform internal checks for communication, internal operations, and evaluate the microprocessor 210 signal output pins for troubleshooting.

Figure 4:
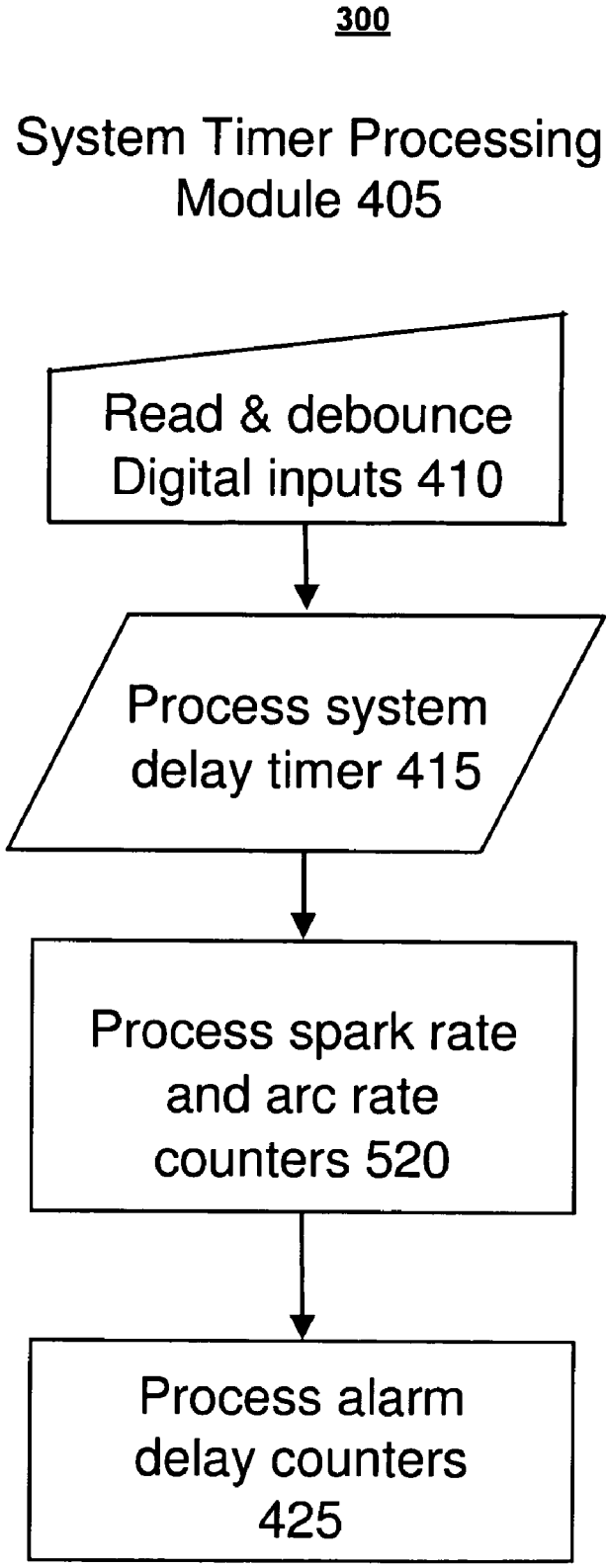
FIG. 4 provides a flow chart for the system timer processing module 405 of the method for precipitator power frequency conversion 300 in accordance with an exemplary embodiment of the present invention.

FIG. 4 provides a flow chart for the system timer processing module 405 of the method for precipitator power frequency conversion 300 in accordance with an exemplary embodiment of the present invention. In the exemplary embodiment shown in FIG. 4, the first step 410 of the system timer processing module 405 involves reading and debouncing the digital inputs of the converter control system 105. For example and not limitation, the input signals evaluated in check alarm conditions step 330 and the check start/stop inputs step 335 of the main processing module 305 can be checked on a time interval in step 410 to eliminate transient signals and ensure a stable input signal is analyzed by the microprocessor 210. Those of skill in the art will appreciate that the reading and debouncing step 410 can be executed in a variety of manners to ensure to the stability of the operations performed by the main processing module 305 of an exemplary embodiment of the method for precipitator power frequency conversion 300.

As shown in FIG. 4, the system timer processing module 405 can also include the step 415 of processing the system delay timer. In an exemplary embodiment, the processing the system delay timer step 415 involves determining the appropriate delay before sending a firing instruction to the IGBT system 115. Furthermore, the system timer processing module 405 can include the step 420 of processing the spark rate and arc counters. In an exemplary embodiment of the converter control system 105, the microprocessor 210 can be configured to execute step 420 by keeping a count of the number of sparks and arcs that the electrostatic precipitator powered by the precipitator power frequency converter system 100 has experienced in the past predetermined time period, such as one minute. By keeping an accurate count of the number and extents of sparks, the converter control system 105 can be configured to more efficiently deliver power. As shown in FIG. 4, the system timer processing module 405 of an exemplary embodiment of the method for precipitator power frequency conversion 300 can also include the step 425 of processing the alarm delay counters. The processing alarm delay counters step 425 can include determining the time period for which a particular default, such as a single phase loss in power, has occurred. In an exemplary embodiment, the method for precipitator power frequency conversion 300 relies upon certain predetermined alarm duration values and when the processing alarm delay counters step 425 determines a predetermined alarm duration value has been exceeded, then the converter control system 105 can activate a particular alarm or shut down a portion of the precipitator power frequency converter system 100.

Figure 5:
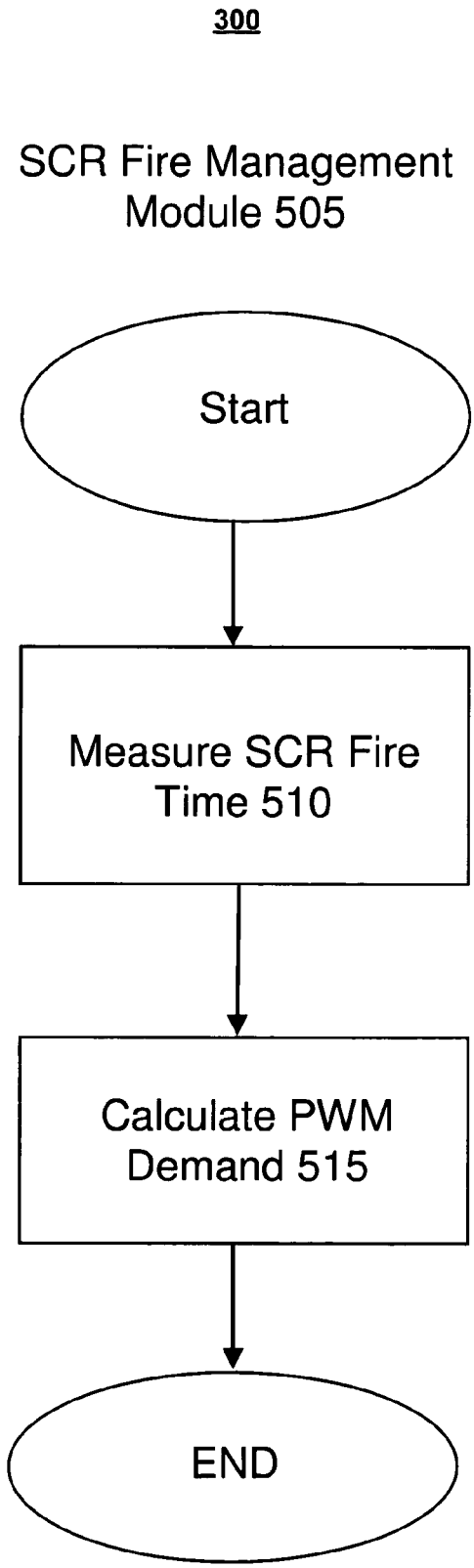
FIG. 5 provides a flow chart for the SCR fire management module 505 of the method for precipitator power frequency conversion 300 in accordance with an exemplary embodiment of the present invention.

FIG. 5 provides a flow chart for the SCR fire management module 505 of the method for precipitator power frequency conversion 300 in accordance with an exemplary embodiment of the present invention. In the exemplary embodiment shown in FIG. 5, the first step 510 of the SCR fire management module 505 involves analyzing the SCR inputs 125 and 130 from the conventional TR controller 110 and the zero cross event. In an exemplary embodiment of the method for precipitator power frequency conversion 300, the step 510 of measuring SCR fire time enables the microprocessor 210 to measure the demand signal. In one embodiment, the measuring SCR fire time step 510 involves reading the SCR outputs, 125 and 130, and also analyzing the input power, such as the "line" voltage, to determine when it passes through the zero level. Specifically, in an exemplary embodiment, the measuring SCR fire time step 510 involves determining the demand of the Conventional TR Controller 110. Next, step 515 of the SCR fire management module 505 involves calculating a Pulse Width Modulation ("PWM") Demand or analyzing the measured demand signal to calculate an internal PWM Demand used to increase or decrease the PWM pulse width of an exemplary embodiment of the precipitator power frequency converter system 100. In an exemplary embodiment, this PWM Demand can be manipulated for the change in frequencies in an exemplary embodiment and can be used as a Demand to control the conduction angle communicated to the IGBT system 115.

Figure 6:
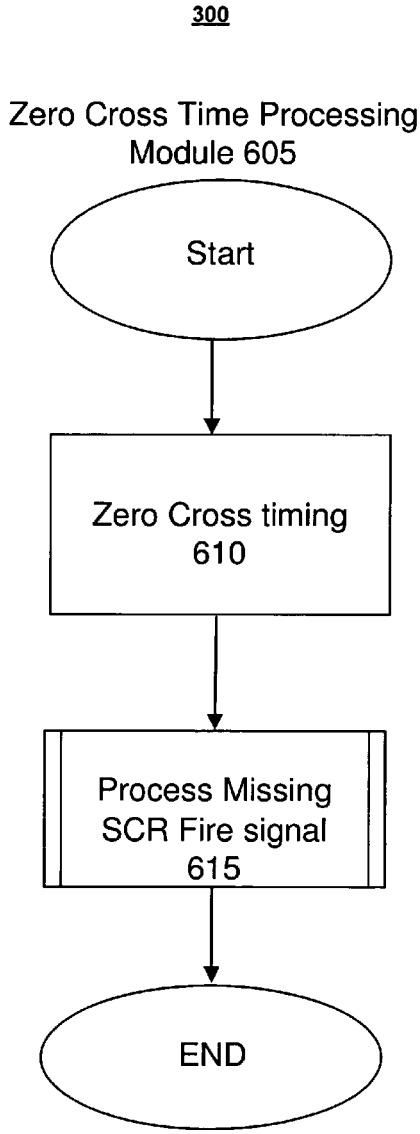
FIG. 6 provides a flow chart for the zero cross time processing module 605 of the method for precipitator power frequency conversion 300 in accordance with an exemplary embodiment of the present invention.

FIG. 6 provides a flow chart for the zero cross time processing module 605 of the method for precipitator power frequency conversion 300 in accordance with an exemplary embodiment of the present invention. In the exemplary embodiment shown in FIG. 6, the zero cross time processing module 605 can require the execution of the zero cross timing step 610 to capture the zero cross as a time event that can be used in an exemplary embodiment to measure SCR fire time. Additionally, the zero cross time processing module 605 can require the execution of step 615 involving processing the missing SCR fire signal. The process missing SCR firing signal step 615 can involve checking for whether an SCR fire input has been received since the previously detected zero cross input.

Figure 7:
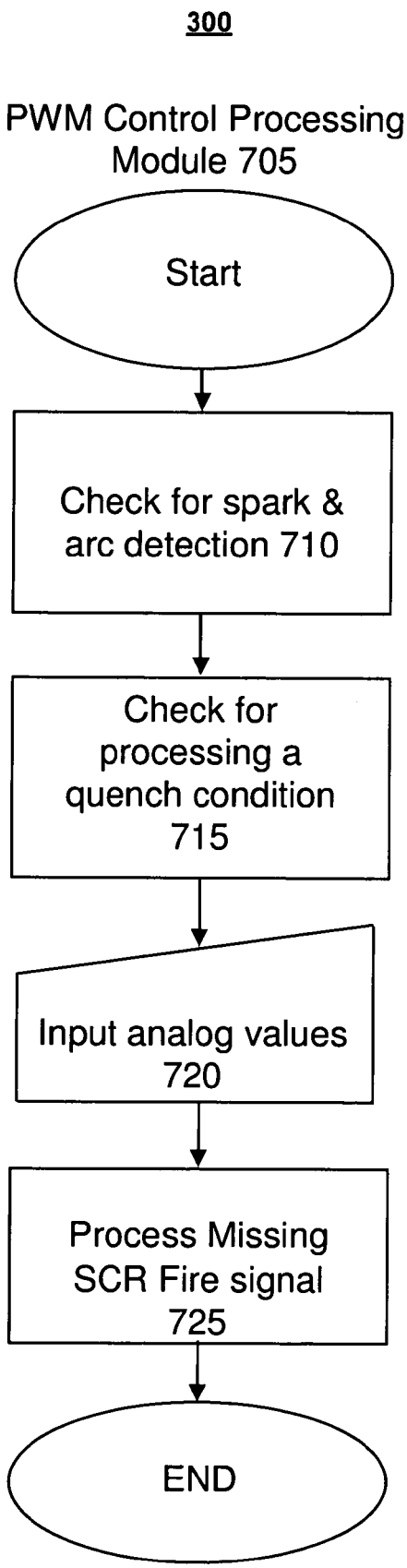
FIG. 7 provides a flow chart for the PWM control processing module 705 of the method for precipitator power frequency conversion 300 in accordance with an exemplary embodiment of the present invention.

FIG. 7 provides a flow chart for the PWM control processing module 705 of the method for precipitator power frequency conversion 300 in accordance with an exemplary embodiment of the present invention. In the exemplary embodiment shown in FIG. 7, the first step 710 of the PWM control processing module 505 involves checking for spark and arc detection. For example and not limitation, the microprocessor 210 can evaluate the signal from the spark detection device 235 to determine whether a spark has been detected since the last evaluation of the signal by the microprocessor 210. In an exemplary embodiment, if a spark has been detected by the spark detection device 235, the method for precipitator power frequency conversion 300 can require an adjustment to the PWM pulse width of the precipitator power frequency converter system 100. Additionally, the step 710 of checking for sparks and arcs can involve checking the secondary voltage reading history to determine the occurrence of a spark based on analog readings.

The PWM control processing module 705 of an exemplary embodiment of the method for precipitator power frequency conversion 300 can also include the step 715 for checking for a quench condition. In then event that quench condition has been instructed by the converter control system 105, then the step 715 of checking for a quench condition can result in a determination by the PWM control processing module 705 of how long the PWM by the precipitator power frequency converter system 100 must be powered off.

The PWM processing control module 705 can also include the step 720 of evaluating input analog values, such as the primary, secondary, and manual control analog values for averaging and spark detection. Furthermore, the PWM processing control module 705 can include the step 725 of calculating the new PWM demand. In an exemplary embodiment of the method for precipitator power frequency conversion 300, the step 725 can involve determining a new optimum PWM demand based on a previous PWM demand criteria and input signals. For example and not limitation, the PWM demand criteria can be configured based on certain user configurable parameters. Therefore, the user can establish various desired responses by the converter control system 105 to a variety of input and alarm situations for the precipitator power frequency converter system 100.

Figure 8:
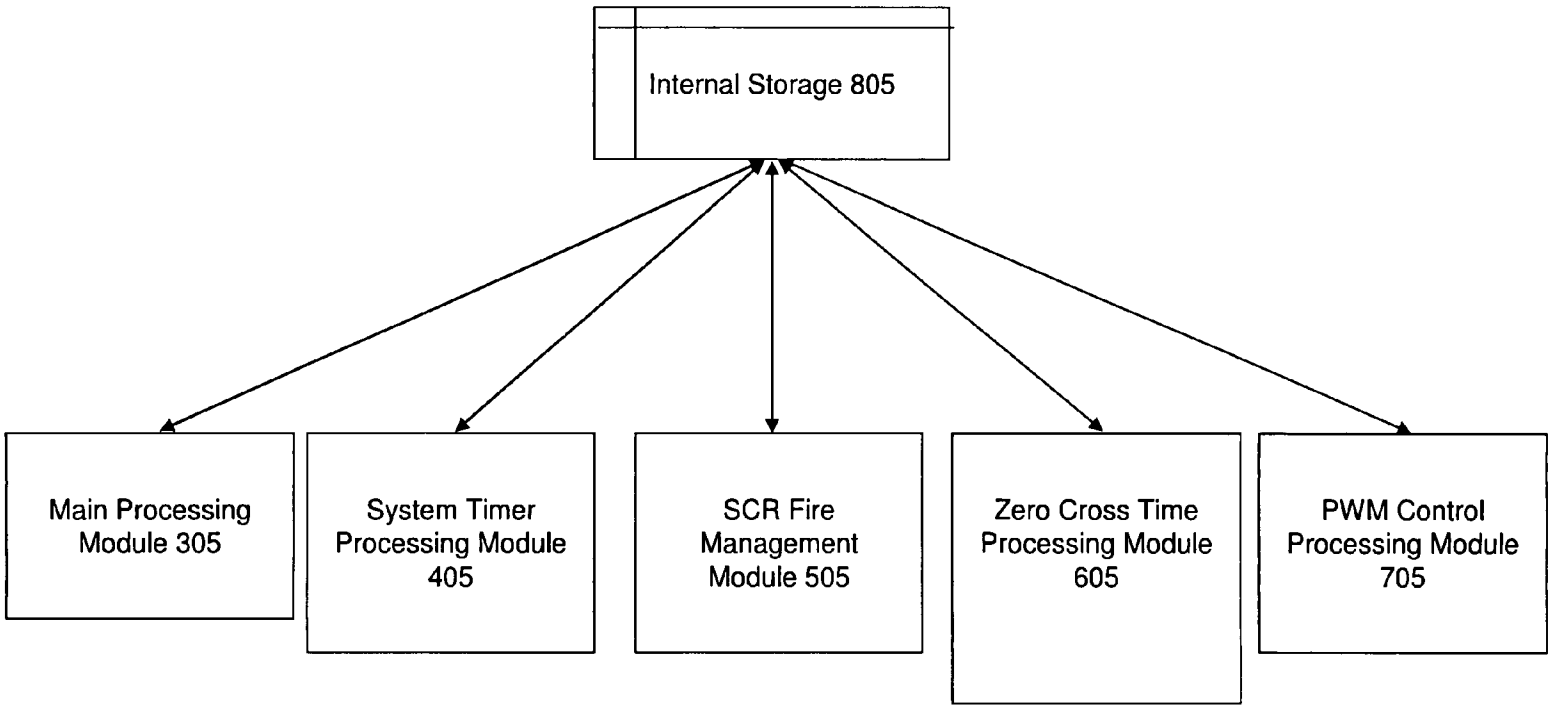
FIG. 8 provides a block diagram of internal storage 805 for the various modules of the method for precipitator power frequency conversion 300 in accordance with an exemplary embodiment of the present invention.

FIG. 8 provides a block diagram of internal storage 805 for the various modules of the method for precipitator power frequency conversion 300 in accordance with an exemplary embodiment of the present invention. As shown in the exemplary embodiment in FIG. 8, each of the modules 305, 405, 505, 605, and 705 of the method for precipitator power frequency conversion 300 can be configured with direct access to the internal storage device 805 of the converter control system 105. Therefore, the method for precipitator power frequency conversion 300 can enable each module to independently access and store the data relevant to the operation of that particular module.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A method for precipitator power frequency conversion comprising:

receiving a first silicon controlled rectifier ("SCR") signal and a second SCR signal from a transformer rectifier control device;

comparing the first and second SCR signals to the point at which the input voltage of a power source passes through zero;

generating a demand signal based on the comparison; and enabling the demand signal to actuate an insulated-gate bipolar transistor ("IGBT") system.

2. The method for precipitator power frequency conversion of claim 1, wherein enabling the demand signal to actuate the IGBT system involves converting the demand signal to a voltage level capable of driving the IGBT system.

3. The method for precipitator power frequency conversion of claim 1, further comprising monitoring a spark detection signal and ceasing to generate a demand signal when the spark detection signal is present.

4. The method for precipitator power frequency conversion of claim 1, further comprising monitoring a phase fail detector signal and ceasing to generate a demand signal when the phase fail signal is present.

5. The method for precipitator power frequency conversion of claim 1, further comprising generating an output from the IGBT system to a transformer rectifier set.

6. A precipitator power frequency converter system comprising:

an insulated-gate bipolar transistor ("IGBT") system;

a converter control system comprising a microprocessor in communication with the IGBT system; and a rectifier set in communication with the IGBT system;

wherein an input power is received by the precipitator power frequency converter system in a first frequency range of approximately 50 Hz to 60 Hz and the precipitator power frequency converter system is enabled to provide an output power in a second frequency range between 400 Hz and 1000 Hz; and wherein the microprocessor is configured to receive a first silicon controlled rectifier ("SCR") signal and a second SCR signal from a transformer rectifier control device.

7. The precipitator power frequency converter system of claim 6, wherein the microprocessor is further configured to compare the first and second SCR signal to the point at which the input voltage of a power source passes through zero and generate a demand signal based on the comparison.

8. The precipitator power frequency converter system of claim 6, wherein the microprocessor is further configured to receive a phase fail detection signal indicating a deficiency in the power source.

9. The precipitator power frequency converter system of claim 6, wherein the microprocessor is further configured to receive a spark detection signal indicating a spark in an electrostatic precipitator.

10. A method of providing power to a device comprising:

receiving a first silicon controlled rectifier ("SCR") signal and a second SCR signal from a controller device;

generating a demand signal by the controller device based on a comparison of the first and second SCR signals;

transmitting the demand signal to a power converter device;

converting a first power signal from a first frequency to a second power signal at a second frequency, wherein the first frequency is in the approximate range of 50 Hz to 60 Hz and the second frequency is in the range of 400 Hz and 1000 Hz; and switching the second power signal to the controller device.

11. A method of providing power to a precipitator comprising:

receiving a first silicon controlled rectifier ("SCR") signal and a second SCR signal from a precipitator controller device;

generating a demand signal by the precipitator controller device based on a comparison of the first and second SCR signals;

transmitting the demand signal to a power converter device;

converting a first power signal from a first frequency to a second power signal at a second frequency, wherein the first frequency is in the range of 100 Hz to 120 Hz and the second frequency is in the range of 400 Hz to 1000 Hz; and switching the second power signal to the precipitator controller device.

* * * * *